US007479739B2

(12) United States Patent
Shimura et al.

(10) Patent No.: US 7,479,739 B2
(45) Date of Patent: Jan. 20, 2009

(54) INVERTER CIRCUIT, BACKLIGHT ASSEMBLY AND LIQUID CRYSTAL DISPLAY WITH THE SAME

(75) Inventors: Tatsuhisa Shimura, Tokyo (JP); Takashi Kinoshita, Tokyo (JP); Osamu Sengoku, Tokyo (JP)

(73) Assignee: Samsung Electronics Co., Ltd. (KR)

( * ) Notice: Subject to any disclaimer, the term of this patent is extended or adjusted under 35 U.S.C. 154(b) by 77 days.

(21) Appl. No.: 11/560,645

(22) Filed: Nov. 16, 2006

(65) Prior Publication Data

US 2007/0120502 A1 May 31, 2007

(30) Foreign Application Priority Data

Nov. 30, 2005 (KR) ..... 10-2005-0115610

(51) Int. Cl.
*H05B 41/24* (2006.01)

(52) U.S. Cl. ..... 315/277; 315/282; 315/312; 345/102

(58) Field of Classification Search ..... 315/276–278, 315/274, 282, 312, 291, DIG. 2, 224, 119, 315/129; 345/102, 87, 84, 55, 30; 349/70, 349/61, 56

See application file for complete search history.

(56) References Cited

U.S. PATENT DOCUMENTS 7,119,495 B2 * 10/2006 Jang ..... 315/291
7,294,971 B2 * 11/2007 Jin ..... 315/246
7,309,964 B2 * 12/2007 Wey et al. ..... 315/312
2004/0257003 A1 * 12/2004 Hsieh et al. ..... 315/312
2005/0253537 A1 * 11/2005 Jang et al. ..... 315/307
2006/0125424 A1 * 6/2006 Gray ..... 315/312
2006/0290453 A1 * 12/2006 Park et al. ..... 336/69

FOREIGN PATENT DOCUMENTS

| | | |
|---|---|---|
| JP | 09-161980 | 6/1997 |
| JP | 2001-126888 | 5/2001 |
| JP | 2002-231034 | 8/2002 |
| JP | 2004-227864 | 8/2004 |
| JP | 2004-273396 | 9/2004 |
| JP | 2005-049747 | 2/2005 |
| KR | 1020050048596 | 5/2005 |

* cited by examiner

*Primary Examiner*—Douglas W. Owens
*Assistant Examiner*—Ephrem Alemu
(74) *Attorney, Agent, or Firm*—Cantor Colburn LLP

(57) ABSTRACT

An inverter circuit, a backlight assembly and a liquid crystal display include first and second electrodes and a balance circuit. The first and second electrodes supply a voltage of opposite polarities, respectively, among an even number of cold cathode fluorescent lamps (CCFLs) disposed in one direction. The first and second electrodes supply the voltage of opposite polarities to even-numbered CCFLs and odd-numbered CCFLs, respectively. The balance circuit controls currents flowing through the CCFLs. The CCFLs are halved into a first group higher in temperature and a second group lower in temperature than the first group. The balance circuit includes primary coils directly connected between at least one CCFL of the first group and at least one CCFL of the second group and secondary coils corresponding to the primary coils that are connected to each other to form a loop.

20 Claims, 8 Drawing Sheets

INVERTER CIRCUIT, BACKLIGHT ASSEMBLY AND LIQUID CRYSTAL DISPLAY WITH THE SAME

This application claims priority to Korean Patent Application No. 2005-115610, filed on Nov. 30, 2005, and all the benefits accruing therefrom under 35 U.S.C. §119, the contents of which in its entirety are herein incorporated by reference.

BACKGROUND OF THE INVENTION

1. Field of the Invention

The present invention relates to an inverter circuit, a backlight assembly and a flat panel display with the backlight assembly.

2. Description of the Related Art

Recently, information processing devices have rapidly advanced to have various shapes and functions. Information processed by such information processing devices is in the form of an electrical signal. Therefore, users require a display device to visually recognize the information processed by the information processing devices.

An example of the display device is a flat panel display device such as a liquid crystal display ("LCD"). An LCD displays an image using liquid crystal. When compared to other display devices, an LCD is thin and lightweight and also has a low power consumption and a low driving voltage. Therefore, an LCD is widely used in various fields.

Such an LCD including a liquid crystal panel displaying an image thereon and a backlight assembly providing light to the liquid crystal panel is described in Japanese Patent Publication No. 2005-49747, for example.

FIG. 1 is a schematic circuit diagram of a conventional backlight assembly.

Referring to FIG. 1, the conventional backlight assembly includes eight cold cathode fluorescent lamps ("CCFLs") 810 and a balance circuit 820. As a liquid crystal panel increases in size, the conventional backlight assembly requires a plurality of CCFLs to provide uniform brightness in the liquid crystal panel.

Sinusoidal voltages are applied from an external inverter 800 to the CCFLs 810, and thus sinusoidal currents flow through the CCFLs 810. If the CCFLs 810 are driven by sinusoidal voltages with the same polarity, the sinusoidal voltages with the same polarity cause an interference with a driving circuit of a liquid crystal panel by generating noise of interference patterns on the liquid crystal panel. To prevent the interference, the CCFLs 810 are divided into two groups as illustrated in FIG. 1, and the two groups are driven respectively by high sinusoidal voltages with opposite polarities. That is, the inverter 800 is configured to output both a high positive voltage is and a high negative voltage. The odd-numbered CCFLs 810 and even-numbered CCFLs 810, starting from the top, are driven by the high positive voltage and the high negative voltage, respectively.

The CCFLs 810 have a negative resistance and are connected in parallel to one another. Therefore, when a current starts to flow through a given one of the CCFLs 810, a resistance of the given CCFL decreases and thus a current easily flows through the given CCFL. This causes concentration of the current at the given CCFL. To prevent the current concentration, the balance circuit 820 is connected in series to the CCFLs 810, as illustrated in FIG. 1.

The balance circuit 820 includes four balance transformers. Each of the balance transformers includes: a primary coil 821 connected directly between neighboring CCFLs receiving the high positive voltage and the high negative voltage, respectively; and a respective secondary coil 822 installed adjacent to the primary coil 821. When a current flows through any one of the CCFLs 810, a current flows through the primary coil 821 and thus a current flows through the respective secondary coil 822. Since the respective secondary coils 822 are connected in series to one another, the current flowing through the secondary coil 822 causes a current to flow through the corresponding primary coil 821. As a result, currents flowing through the respective CCFLs 810 become equal to one another.

In this configuration, a balancing voltage of each balance transformer that is necessary to balance the CCFLs 810 is obtained by grounding one point of the series connected secondary coils 822 and detecting a voltage between the grounded point and a detection node 830 remote from the grounded point. In a normal state, the balancing voltage is in the range of, for example, 1 V to 2 V.

This balancing voltage varies with a distribution of resistances including the negative resistances of the CCFLs 810. Using this property, a short or open circuit due to a failure in the CCFLs 810 can be detected. That is, when a short circuit occurs due to a failure in the CCFLs 810, a voltage (e.g., 5~6 V) higher than the balancing voltage in the normal state is detected at the detection node 830 as a result of the balancing operation of the balance transformers.

FIG. 2 illustrates an arrangement of CCFLs in the conventional backlight assembly of FIG. 1.

Referring to FIG. 2, the CCFLs 810 are arranged horizontally in a vertically-standing protection structure 920. The rear surface of the protection structure 920 is covered with a reflection plate 910, and the front surface of the protection structure 920 is covered with a diffusion plate 900. In the conventional backlight assembly, temperature increases upward due to heat by light emitted from the CCFLs 810, resulting in a temperature gradient.

The CCFLs 810 each have a temperature-dependent resistance. Therefore, due to the temperature gradient, the CCFLs 810 have a resistance that is lowered as the CCFLs 810 are further spaced apart from a lower portion of protection structure 920. In other words, the CCFLS 810 have an increase in voltage due to the lowered resistance based on the temperature gradient from bottom to top of the protection structure 920 (e.g., the temperature increases from bottom to top of the protection structure 920).

To eliminate the resistance difference between the CCFLs 810, the balance transformers operate to balance the CCFLs 810. Accordingly, a voltage of, for example, about 3V is induced at the detection node 830. However, when an increase in voltage is detected at the detection node 830 in the conventional backlight assembly, it is impossible to determine whether a resistance difference between the CCFLs 810 or a short circuit due to a failure in the CCFLs 810 has caused the voltage increase. Accordingly, it is difficult to accurately trouble-shoot a failure in the CCFLs 810.

BRIEF SUMMARY OF THE INVENTION

One aspect of the present invention is to provide an inverter circuit to easily troubleshoot a failure in CCFLs, as well as providing a backlight assembly and a liquid crystal display having the above backlight assembly.

In exemplary embodiment of the present invention, an inverter circuit includes first and second electrodes supplying voltage of opposite polarities, respectively, among an even number of CCFLs disposed in one direction, to even-numbered CCFLs and odd-numbered CCFLs, and a balance circuit controlling currents flowing through the CCFLs. The CCFLs are halved into a first group higher in temperature and a second group lower in temperature than the first group, and the balance circuit includes a plurality of primary coils directly connected between at least one of the first group and at least one of the second group and a plurality of secondary coils corresponding to the primary coils and connected to each other to form a loop.

Each of the primary coils is directly connected between at least one of the odd-numbered CCFLs in the first group and at least one of the even-numbered CCFLs in the second group, or between at least one of the even-numbered CCFLs in the first group and at least one of the odd-numbered CCFLs in the second group.

One point of the secondary coils that are serially connected in the loop is grounded, and the balance circuit further includes a voltage detector detecting a voltage between the grounded point and a detection node remote from the grounded point.

The CCFLs are each disposed horizontally and arranged vertically with respect to one another. Each of the primary coils may be directly connected between at least one pair of the CCFLs located at vertically symmetrical positions. Alternatively, each of the primary coils may be directly connected between a CCFL at a highest position and a CCFL at a lowest position of the vertically arranged CCFLs and between two adjacent CCFLs among remaining CCFLs.

In another exemplary embodiment of the present invention, a backlight assembly includes an even number of CCFLs disposed in one direction. The backlight assembly includes first and second electrodes supplying voltage of opposite polarities, respectively, to even-numbered CCFLs and odd-numbered CCFLs among the CCFLs, and a balance circuit controlling currents flowing through the CCFLs. The CCFLs are halved into a first group higher in temperature and a second group lower in temperature than the first group, and the balance circuit includes a plurality of primary coils directly connected between at least one of the first group and at least one of the second group, and a plurality of secondary coils corresponding to the primary coils. The secondary coils are serially connected to each other to form a loop.

Each of the primary coils is directly connected between at least one of the odd-numbered CCFLs in the first group and at least one of the even-numbered CCFLs in the second group, or between at least one of the even-numbered CCFLs in the first group and at least one of the odd-numbered CCFLs in the second group.

One point of the secondary coils serially connected in the loop is grounded, and the balance circuit further includes a voltage detector detecting a voltage between the grounded point and a detection node remote from the grounded point.

The CCFLs are each disposed horizontally and arranged vertically with respect to one another. Each of the primary coils may be directly connected between at least one pair of the CCFLs located at vertically symmetrical positions. Alternatively, each of the primary coils may be directly connected between a CCFL at a highest position and a CCFL at a lowest position of the CCFLs and between two adjacent CCFLs among remaining CCFLs.

The CCFLs are disposed in a vertically-standing protection structure, and the protection structure has a rear surface covered with a reflection plate and a front surface covered with a diffusion plate.

In yet another exemplary embodiment of the present invention, a liquid crystal display includes a liquid crystal panel receiving a light to display an image and a backlight assembly. The backlight assembly includes an even number of cold cathode fluorescent lamps disposed in one direction to provide the liquid crystal panel with the light, a first electrode supplying a first voltage having a polarity to even-numbered cold cathode fluorescent lamps among the cold cathode fluorescent lamps, a second electrode supplying a second voltage having an opposite polarity to the first voltage to odd-numbered cold cathode fluorescent lamps among the cold cathode fluorescent lamps, and a balance circuit controlling currents flowing through the cold cathode fluorescent lamps. The cold cathode fluorescent lamps are halved into a first group higher in temperature and a second group lower in temperature than the first group, and the balance circuit includes a plurality of primary coils directly connected between at least one of the first group and at least one of the second group, and a plurality of secondary coils corresponding to the primary coils. The secondary coils are serially connected to each other to form a loop.

BRIEF DESCRIPTION OF THE DRAWINGS

The above and other aspects, advantages and features of the present invention will become readily apparent by reference to the following detailed description when considered in conjunction with the accompanying drawings wherein.

DETAILED DESCRIPTION OF THE INVENTION

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Reference will now be made in detail to the exemplary embodiments of the present invention, examples of which are illustrated in the accompanying drawings. However, the present invention is not limited to the exemplary embodiments illustrated herein after, and the exemplary embodiments herein are rather introduced to provide easy and complete understanding of the scope and spirit of the present invention.

Inverter circuits, backlight assemblies, and liquid crystal displays ("LCDs") with the same, according to exemplary embodiments of the present invention, will now be described with reference to FIGS. 3 through 9.

Figure 3:
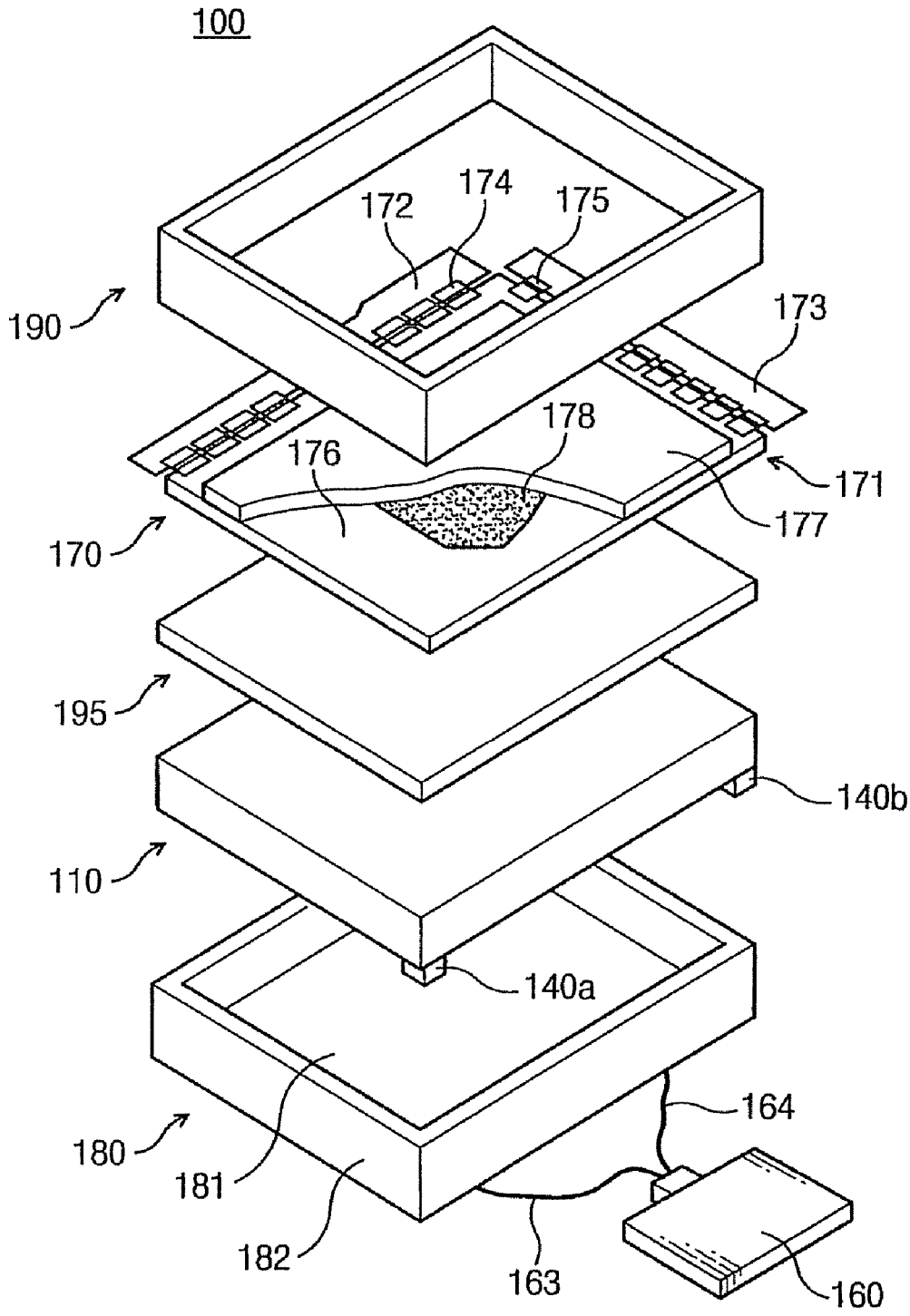
FIG. 3 is an exploded perspective view of a liquid crystal display according to an exemplary embodiment of the present invention.

FIG. 3 is an exploded perspective view of an LCD according to an exemplary embodiment of the present invention.

Referring to FIG. 3, an LCD 100 includes a backlight assembly 110, a display unit 170 and a receiving container 180.

The display unit 170 includes a liquid crystal panel 171 displaying an image, and a data driving circuit 172 and a gate driving circuit 173 that supply driving signals to the liquid crystal panel 171. The data driving circuit 172 is connected to the liquid crystal panel 171 through a data tape carrier package ("TCP") 174, and the gate driving circuit 173 is connected to the liquid crystal panel 171 through a gate TCP 175.

The liquid crystal panel 171 includes a thin film transistor ("TFT") substrate 176, a color filter substrate 177 facing the TFT substrate 176 and a liquid crystal layer 178 interposed between the TFT substrate 176 and the color filter substrate 177.

The TFT substrate 176 may be, for example, a transparent glass substrate where switching TFTs are arranged in a matrix configuration. Each of the TFTs has a source terminal connected to a data line, a gate terminal connected to a gate line, and a drain terminal connected to a transparent conductive pixel electrode (not illustrated).

The color filter substrate 177 is, for example, a substrate where red, green and blue ("RGB") color pixels (not illustrated) are formed thereon by a thin film process. A transparent conductive common electrode (not illustrated) is formed on the color filter substrate 177.

The receiving container 180 includes a bottom plate 181 and sidewalls 182 formed on edges of the bottom plate 181 to form a receiving space. The receiving container 180 fixes the backlight assembly 110 and the liquid crystal panel 171 thereto.

The bottom plate 181 has a sufficient surface area for receiving the backlight assembly 110. The bottom plate 181 and the backlight assembly 110 may have a same shape. In this exemplary embodiment, the bottom plate 110 and the backlight assembly may have a substantially square plate-like shape. The sidewalls 182 extend from the edge of the bottom plate 181 in a direction approximately perpendicular to the bottom plate 181.

The LCD 100 may further include an inverter 160.

The inverter 160 is disposed outside the receiving container 180 to generate a discharge voltage to drive the backlight assembly 110. The discharge voltage from the inverter 160 is applied to the backlight assembly 110 through a first power supply line 163 and a second power supply line 164. The first and second power supply lines 163 and 164 are connected to first and second electrodes 140*a* and 140*b* that are formed at both sides of the backlight assembly 110, respectively. The first and second power supply lines 163 and 164 may be directly connected to the first and second electrodes 140*a* and 140*b*, respectively. Alternatively, the first and second power supply lines 163 and 164 may be indirectly connected to the first and second electrodes 140*a* and 140*b*, respectively, using a separate connection member (not illustrated).

The LCD 100 also further includes a top chassis 190. The top chassis 190 is coupled to the receiving container 180 while surrounding an edge portion of the liquid crystal panel 171. The top chassis 190 prevents the liquid crystal panel 171 from being damaged by an external impact and from being separated from the receiving container 180.

The LCD 100 may further include at least one optical sheet 195 to enhance characteristics of light emitted from the backlight assembly 110. The optical sheet 195 may include a diffusion sheet to diffuse the light and a prism sheet to condense the light.

Figure 4:
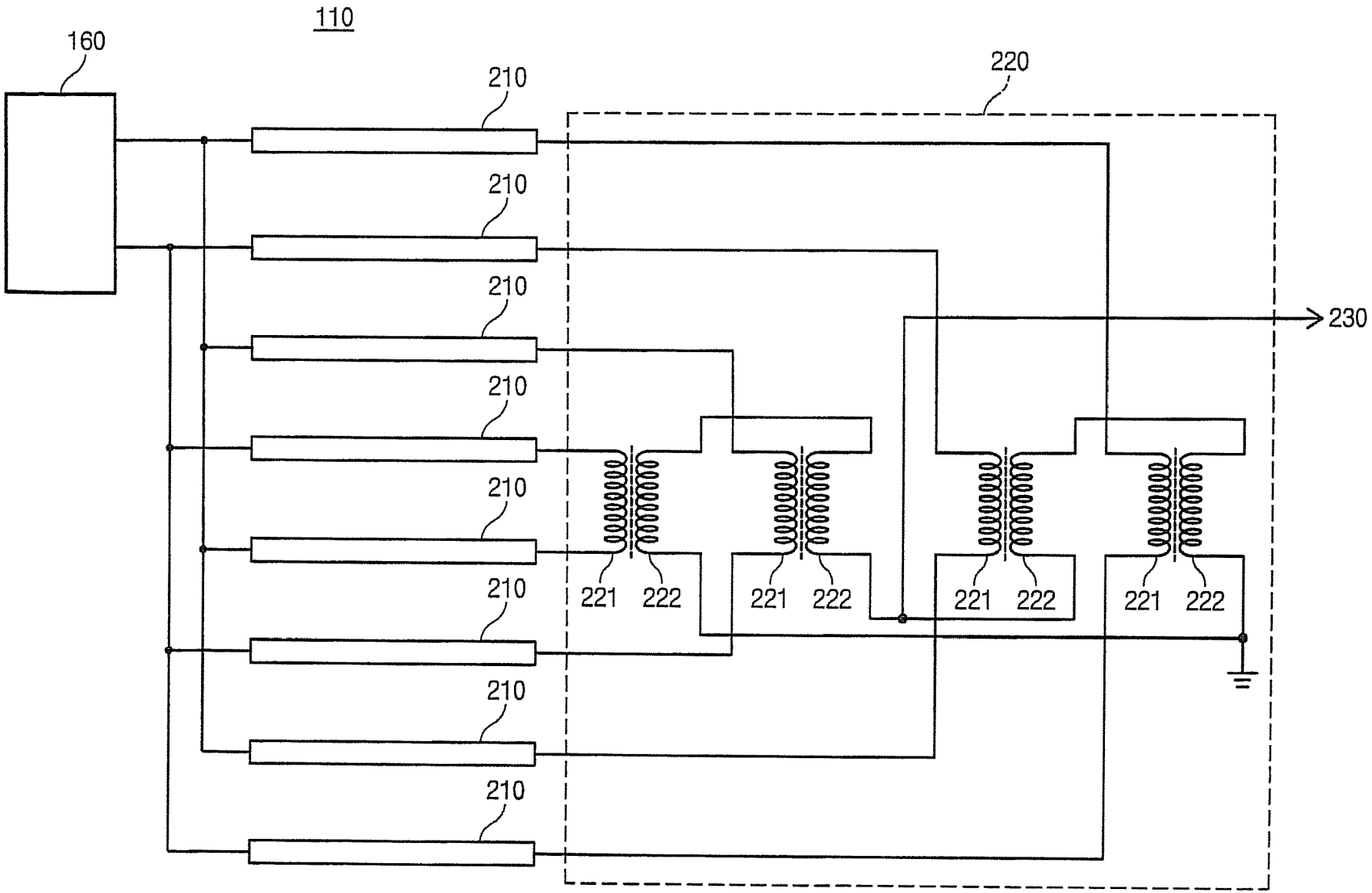
FIG. 4 is a schematic circuit diagram of a backlight assembly according to an exemplary embodiment of the present invention.

FIG. 4 is a schematic circuit diagram of the backlight assembly 110 according to an exemplary embodiment of the present invention.

Referring to FIG. 4, the backlight assembly 100 includes eight cold cathode fluorescent lamps ("CCFLs") 210 and a balance circuit 220.

A sinusoidal voltage from the inverter 160 of FIG. 3 is applied to the CCFLs 210. This causes sinusoidal currents to flow through the CCFLs 210. The CCFLs 210 are divided into two groups, and the two groups, for example odd-numbered CCFLs 210 and even-numbered CCFLs 210, are driven by high sinusoidal voltages of opposite polarities. That is, the inverter 160 can output both a high positive voltage and a high negative voltage, and the odd-numbered CCFLs 210 and the even-numbered CCFLs 210, starting from a top as illustrated in FIG. 4, are driven by the high positive voltage and the high negative voltage, respectively.

Figure 2:
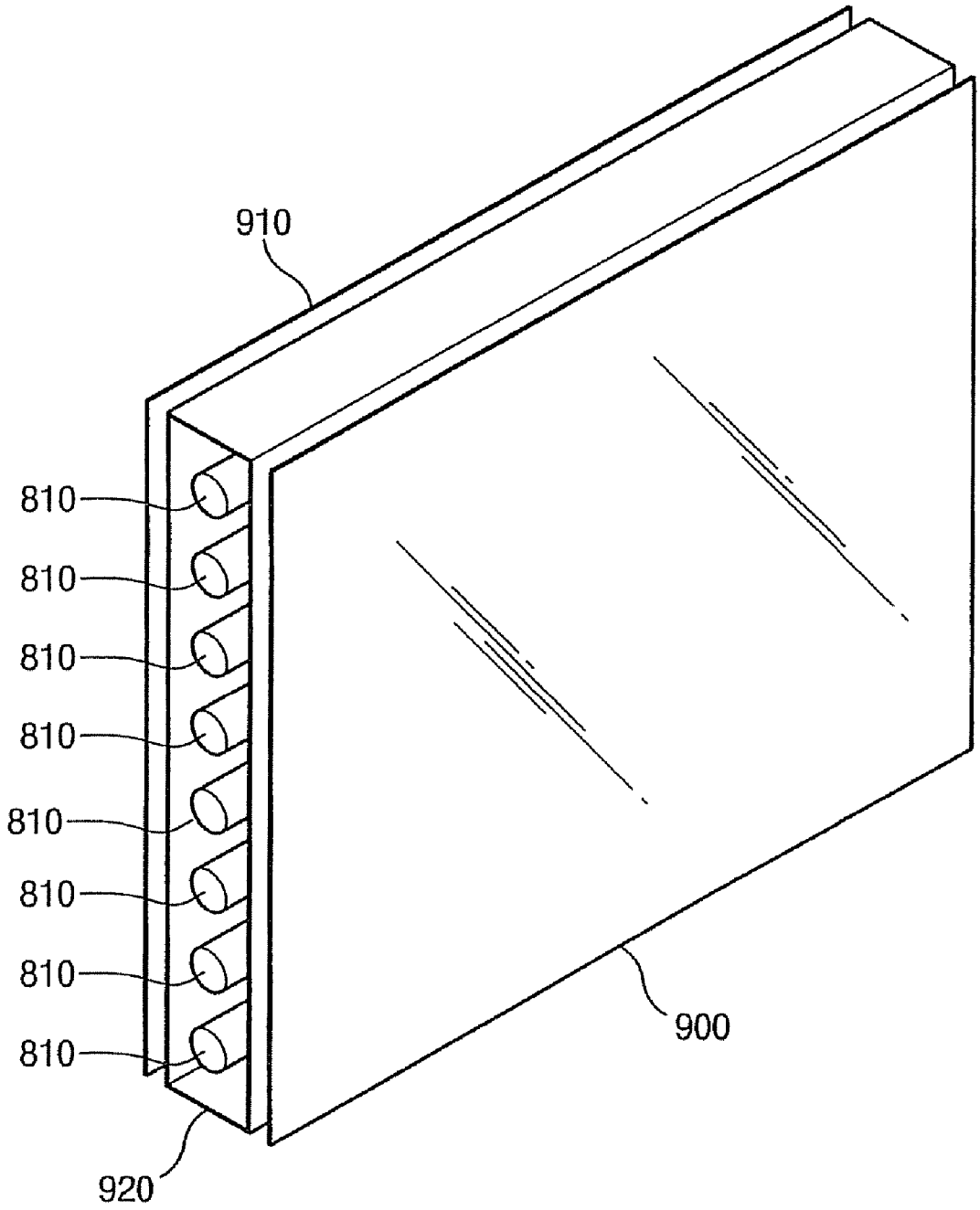
Fig. 2 (PRIOR ART)
FIG. 2 illustrates the arrangement of lamps of the conventional backlight assembly.

The CCFLs 210 may be, for example, a commercial CCFL. Although eight CCFLs 210 are illustrated in FIG. 2, the present invention is not limited thereto. That is, the number of the CCFLs 210 may be any even number.

Figure 5:
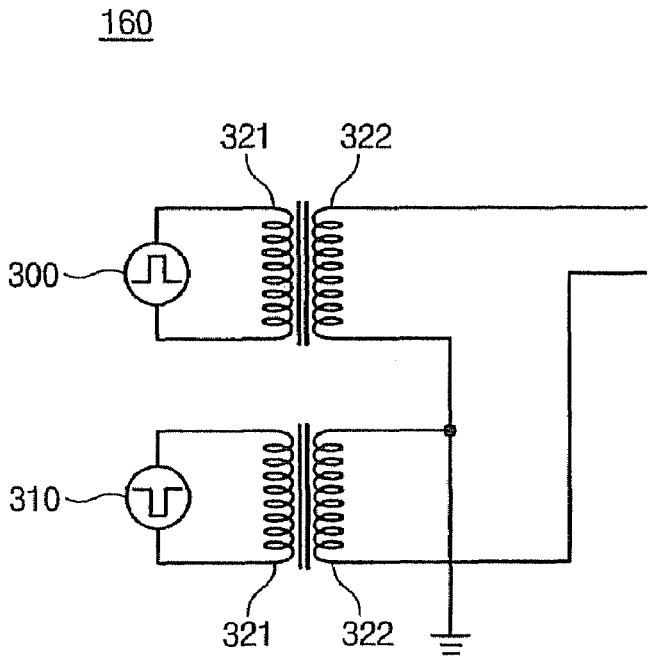
FIG. 5 is a schematic circuit diagram of an inverter used in the liquid crystal display according to an exemplary embodiment of the present invention.
Figure 6:
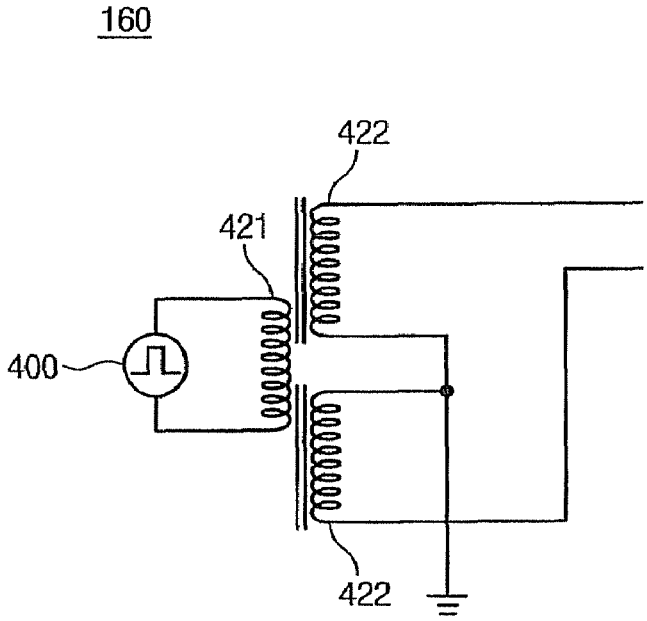
FIG. 6 is a schematic circuit diagram of an inverter used in the liquid crystal display according to another exemplary embodiment of the present invention.

FIGS. 5 and 6 are schematic circuit diagrams showing exemplary embodiments of the inverter 160 according to the present invention.

Referring to FIG. 5, the inverter 160 includes two power sources 300 and 310 that output the high positive voltage and the high negative voltage, respectively, two primary coils 321 that are connected to the power sources 300 and 310, respectively, and two secondary coils 322 that are disposed adjacent to the primary coils 321, respectively.

Referring to FIG. 6, the inverter 160 includes one power source 400, one primary coil 421 connected to the power source 400 and two secondary coils 422 that are disposed adjacent to the primary coil 421. Here, the secondary coils 422 are configured such that their sinusoidal voltages have opposite polarities, thereby outputting both the high positive voltage and the high negative voltage.

Referring back to FIG. 4, the balance circuit 220 includes four balance transformers. The balance transformers include primary coils 221 connected, respectively, between the highest CCFL and the lowest CCFL (e.g., the two outboard CCFLs 210), between the second-highest CCFL and the second-lowest CCFL, between the third-highest CCFL and the third-lowest CCFL, and between the fourth-highest CCFL and the fourth-lowest CCFL (e.g., adjacent middle CCFLs 210), and secondary coils 222 disposed adjacent to the primary coils 221, respectively. When a current flows through one of the CCFLs 210, a current flows through a corresponding primary coil of the primary coils 221 and thus a current also flows through an adjacent secondary coil to the corresponding primary coil of the secondary coils 222. Since the secondary coils 222 are connected in series to one another, the currents flowing through the secondary coils 222 cause currents to flow through the corresponding primary coils 221. As a result, currents flowing through the CCFLs 210 are controlled such that amounts of the currents flowing through the CCFLs 210 become equal to one another. The primary and secondary coils 221 and 222 may have an inductance of, for example, but without limitation, between about 100 μH to about 700 μH.

In this configuration, a balancing voltage of each balance transformer that is necessary to balance the CCFLs 210 can be obtained by grounding one point of the secondary coils 222 and detecting a voltage between the grounded point and a detection node 230 remote from the grounded point. In a normal state, the balancing voltage is in the range of about 1 volt to about 2 volts.

The balancing voltage varies with a distribution of resistances including negative resistances of the CCFLs 210. Using this property, a short or open circuit due to a failure in the CCFL 210 can be detected. That is, when a short or open circuit occurs due to the failure in the CCFLs 210, a voltage (e.g., 5 V~6 V) higher than the voltage in the normal state is detected at the detection node 230 as a result of the balancing operation of the balance transformers.

The voltage between the grounded point and the detection node 230 may be detected using any voltage detector that can detect a voltage between two points.

Figure 7:
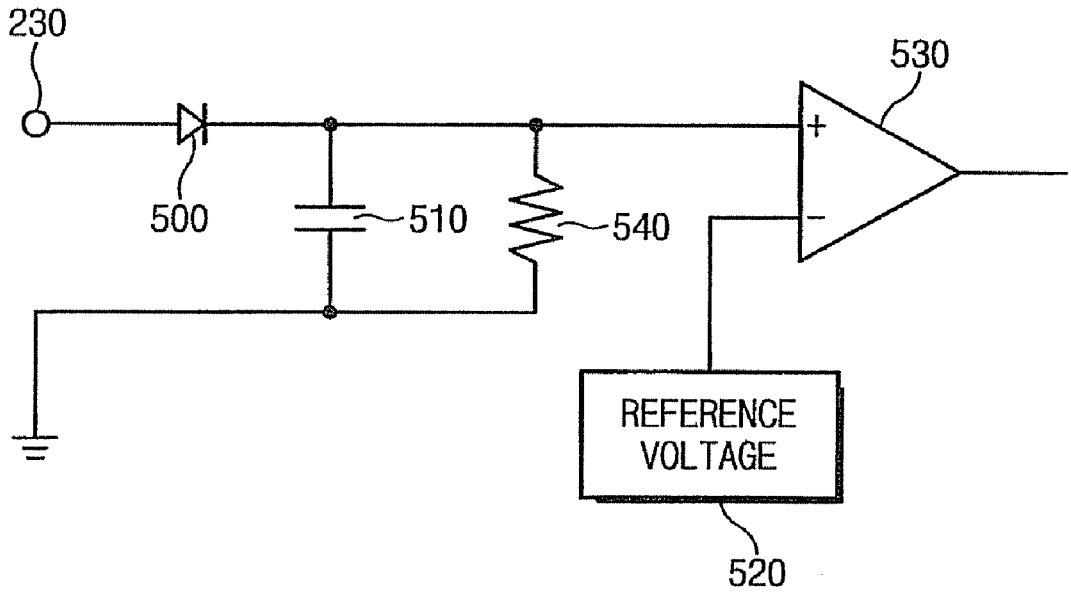
FIG. 7 is a schematic circuit diagram of a voltage detector used in the liquid crystal display according to an exemplary embodiment of the present invention.

FIG. 7 is a schematic circuit diagram showing an exemplary embodiment of the voltage detector used in the LCD according to the present invention.

Referring to FIG. 7, the voltage detector includes a diode 500, a capacitor 510, a resistor 540 and a comparator 530. When a reference voltage 520 is applied to the comparator 530 and the voltage between the ground voltage at the grounded point and the detection node 230 is higher than the reference voltage 520, the comparator 530 outputs a signal "H". On the contrary, when the voltage between the ground voltage at the grounded point and the detection node 230 is lower than the reference voltage 520, the comparator 530 outputs a signal "L".

Figure 8:
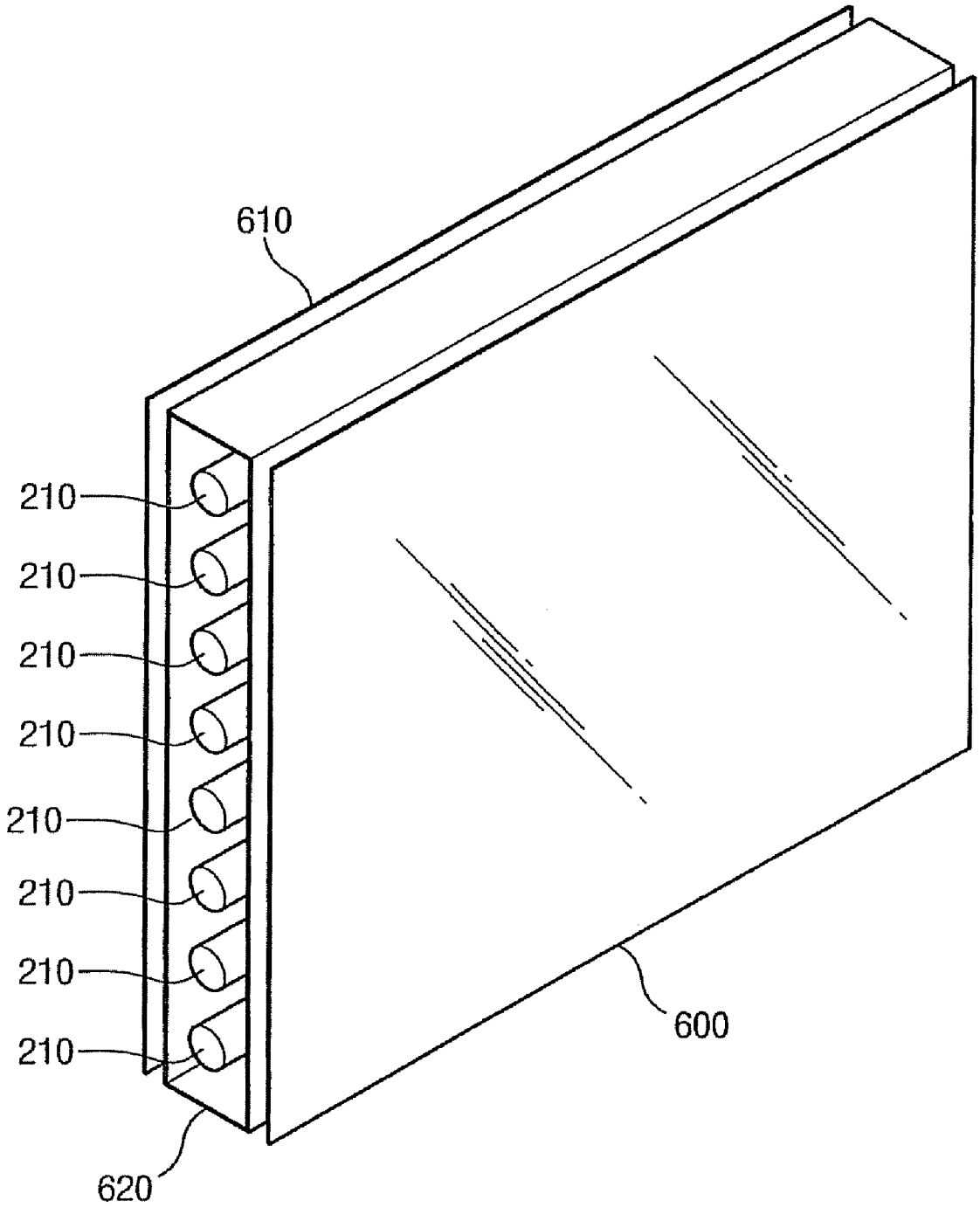
FIG. 8 illustrates an arrangement of lamps of a backlight assembly according to an exemplary embodiment of the present invention.

FIG. 8 is a perspective view illustrating an arrangement of the backlight assembly 110 according to an exemplary embodiment of the present invention.

Referring to FIG. 8, the CCFLs 210 are arranged horizontally in a vertically-standing protection structure 620. The protection structure 620 has a rear surface covered with a reflection plate 610 and a front surface covered with a diffusion plate 600. Accordingly, temperature increases upward due to heat from light emitted from the CCFLs 210, resulting in a temperature gradient. The CCFLs 210 each has a temperature-dependent resistance. Therefore, due to the temperature gradient, the upper CCFL 210 has a lower resistance while the lower CCFL 210 has a higher resistance. To reduce the resistance difference between the CCFLs 210, the balance transformers operate to balance the CCFLs 210.

Referring again to FIG. 4, the primary coils 221 are disposed, respectively, between the highest CCFL 210 with the lowest resistance and the lowest CCFL 210 with the highest resistance (e.g., the two outboard CCFLs 210), between the second-highest CCFL 210 with the second-lowest resistance and the second-lowest CCFL 210 with the second-highest resistance, between the third-highest CCFL 210 with the third-lowest resistance and the third-lowest CCFL 210 with the third-highest resistance, and between the fourth-highest CCFL 210 with the fourth-lowest resistance and the fourth-lowest CCFL 210 with the fourth-highest resistance (e.g., adjacent middle CCFLs 210).

The sums of the resistances of the respective two CCFLs 210 connected to the respective balance transformers are averaged to reduce the unbalance thereof due to the temperature gradient. As a result, unlike in the conventional backlight assembly where the primary coil of the balance transformer is disposed between the two adjacent CCFLs 810, in the backlight assembly 110 of the present invention, the increase in the voltage at the detection node 230 caused by the voltage difference between the respective CCFLs 210 due to the temperature gradient can be detected. Accordingly, it can be determined that an increase in a voltage detected at the detection node 230 is caused by a short circuit due to a failure in a CCFL 210. Consequently, it is possible to easily troubleshoot the failure in the CCFL 210.

Figure 9:
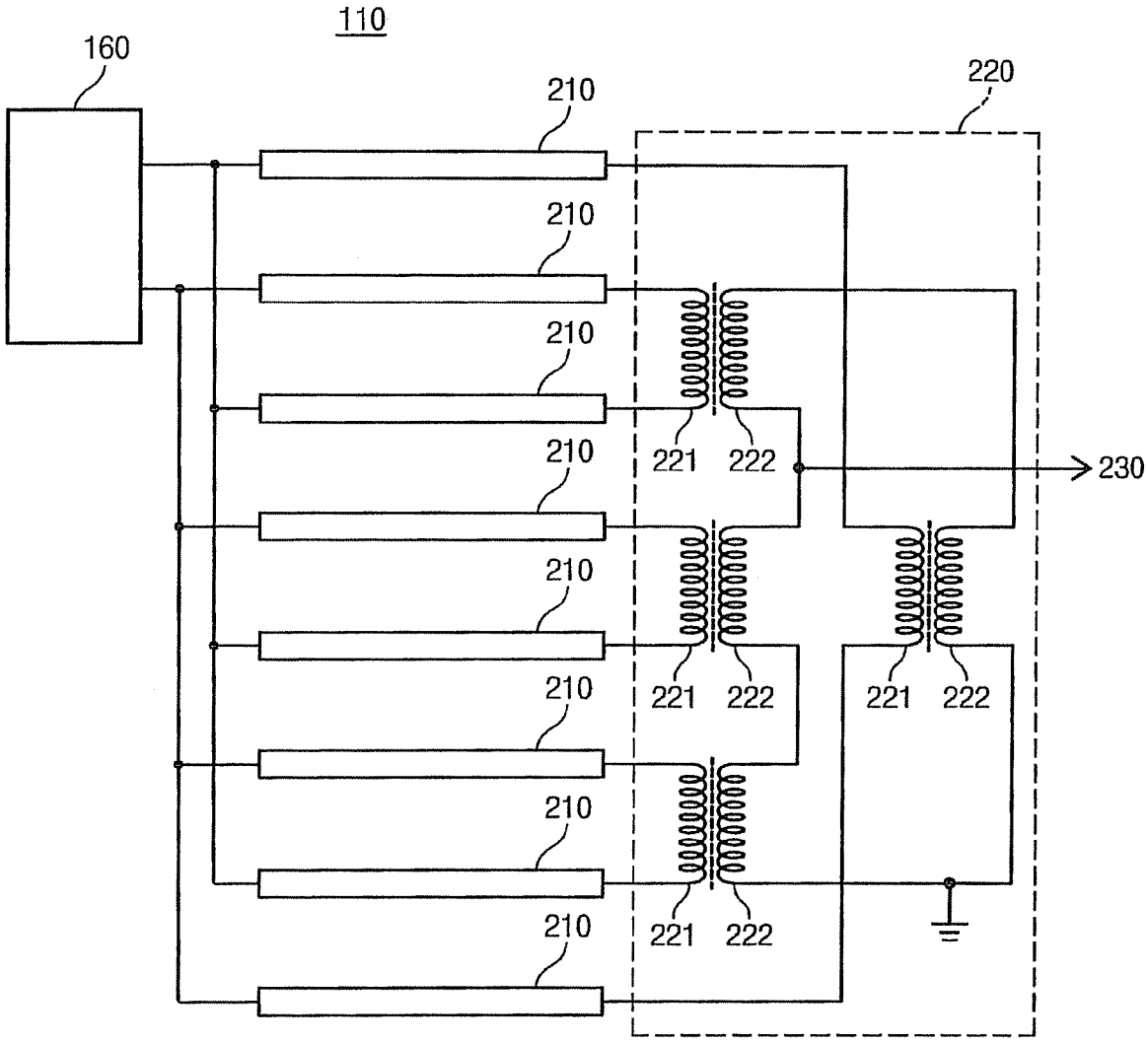
FIG. 9 is a schematic circuit diagram of a backlight assembly according to an exemplary embodiment of the present invention.

FIG. 9 is a schematic circuit diagram showing another exemplary embodiment of the backlight assembly 110 according to the present invention.

In the present exemplary embodiment of FIG. 9, a backlight assembly 110 is configured to have a same circuit configuration as that of the backlight assembly 110 of FIG. 2 with the exception that a balance circuit 220 of FIG. 9 is different in structure from the balance circuit 220 of FIG. 2.

Referring to FIG. 9, in the backlight assembly 110, primary coils 221 of balance transformers are disposed, respectively, between the highest CCFL 210 with the lowest resistance and the lowest CCFL 210 with the highest resistance (e.g., the two outbound CCFLs 210), between the second-highest CCFL 210 with the second-lowest resistance and the third-highest CCFL 210 with the third-lowest resistance, between the fourth-highest CCFL 210 with the fourth-lowest resistance and the fourth-lowest CCFL 210 with the fourth-highest resistance (e.g., the two adjacent middle CCFLs 210), and between the third-lowest CCFL 210 with the third-highest resistance and the second-lowest CCFL 210 with the second-highest resistance.

Figure 1:
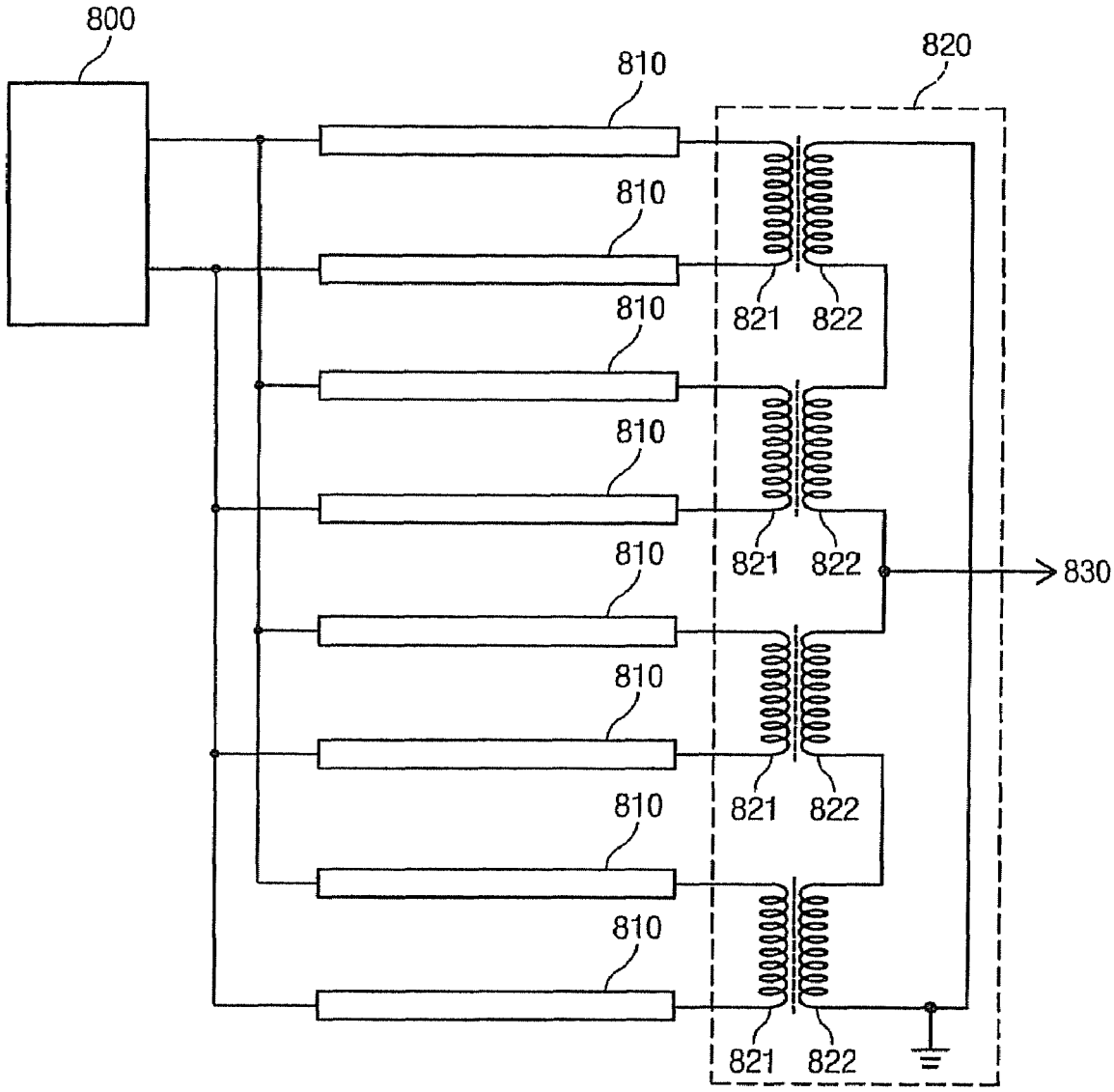
Fig. 1 (PRIOR ART)
FIG. 1 is a schematic circuit diagram of a conventional backlight assembly.

In order to balance the sums of the resistances of the respective two CCFLs 210 connected to the respective balance transformers, it is preferable that each of the primary coils 221 is disposed between the corresponding two CCFLs 210 located at vertically symmetrical positions, as illustrated in FIG. 4. However, as illustrated in FIG. 9, when at least one of the primary coils 221 is disposed between at least one of the odd-numbered upper disposed CCFLs 210 (lower in resistance) and at least one of the even-numbered lower disposed CCFLs 210 (higher in resistance), starting from the top, the distribution of the sums of the respective two CCFLs 210 connected to the respective balance transformers can be reduced when compared to the case of the conventional backlight assembly of FIG. 1. Consequently, when compared to the case of the conventional backlight assembly, it is possible to easily troubleshoot a failure in the CCFL 210. Likewise, when at least one of the primary coils 221 is disposed between at least one of the even-numbered upper disposed CCFLs 210 (higher in resistance) and at least one of the odd-numbered lower disposed CCFLs 210 (lower in resistance), starting from the top, it is possible to easily troubleshoot the failure in the CCFLs 210.

Consequently, the present invention can provide inverter circuits and backlight assemblies that make it possible to easily troubleshoot the failure in the CCFLs. The backlight assemblies according to the present invention can be applied very suitably to an LCD, and also to other devices.

As described above, the inverter circuits, the backlight assemblies, and the LCDs according to the present invention can reduce the unbalance of the sums of the resistances of respective two CCFLs connected to the respective primary coils, when compared to the conventional devices. Consequently, the present invention makes it possible to easily troubleshoot the failure in the CCFLs of the backlight assembly.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An inverter circuit comprising:

a first electrode supplying a first voltage having a polarity to even-numbered cold cathode fluorescent lamps among an even number of cold cathode fluorescent lamps disposed in one direction;

a second electrode supplying a second voltage having an opposite polarity to the first voltage to odd-numbered cold cathode fluorescent lamps; and a balance circuit controlling currents flowing through the cold cathode fluorescent lamps, wherein the cold cathode fluorescent lamps are halved into a first group higher in temperature and a second group lower in temperature than the first group, and the balance circuit comprises:

a plurality of primary coils directly connected to the lamps, at least one primary coil of the plurality of primary coils is directly connected between a cold cathode fluorescent lamp at a highest position of the first group and a cold cathode fluorescent lamp at a lowest position of the second group; and a plurality of secondary coils corresponding to the primary coils and connected to each other to form a loop.

2. The inverter circuit of claim 1, wherein each of the primary coils is directly connected between at least one of the odd-numbered cold cathode fluorescent lamps in the first group and at least one of the even-numbered cold cathode fluorescent lamps in the second group, or between at least one of the even-numbered cold cathode florescent lamps in the first group and at least one of the odd-numbered cold cathode fluorescent lamps in the second group.

3. The inverter circuit of claim 2, wherein one point of the secondary coils connected to each other is grounded, and the balance circuit further comprises a voltage detector detecting a voltage between the grounded point and a detection node remote from the grounded point.

4. The inverter circuit of claim 1, wherein the even number of the cold cathode fluorescent lamps are each disposed horizontally and arranged vertically with respect to one another.

5. The inverter circuit of claim 4, wherein each of the primary coils is directly connected between at least one pair of the cold cathode fluorescent lamps located at vertically symmetrical positions.

6. The inverter circuit of claim 4, wherein each of the primary coils is directly connected either between a cold cathode fluorescent lamp at a highest position and a cold cathode fluorescent lamp at a lowest position of the cold cathode fluorescent lamps or between two adjacent cold cathode fluorescent lamps among remaining cold cathode fluorescent lamps.

7. A backlight assembly comprising:

an even number of cold cathode fluorescent lamps disposed in one direction;

a first electrode supplying a first voltage having a polarity to even-numbered cold cathode fluorescent lamps among the cold cathode fluorescent lamps;

a second electrode supplying a second voltage having an opposite polarity to the first voltage to odd-numbered cold cathode fluorescent lamps among the cold cathode fluorescent lamps; and a balance circuit controlling currents flowing through the cold cathode fluorescent lamps, wherein the cold cathode fluorescent lamps are halved into a first group higher in temperature and a second group lower in temperature than the first group, and the balance circuit comprises:

a plurality of primary coils directly connected to the lamps, at least one primary coil of the plurality of primary coils is directly connected between a cold cathode fluorescent lamp at a highest position of the first group and a cold cathode fluorescent lamp at a lowest position of the second group; and a plurality of secondary coils corresponding to the primary coils and connected to each other to form a loop.

8. The backlight assembly of claim 7, wherein each of the primary coils is directly connected between at least one of the odd-numbered cold cathode fluorescent lamps in the first group and at least one of the even-numbered cold cathode fluorescent lamps in the second group, or between at least one of the even-numbered cold cathode fluorescent lamps in the first group and at least one of the odd-numbered cold cathode fluorescent lamps in the second group.

9. The backlight assembly of claim 8, wherein one point of the secondary coils connected to each other is grounded, and the balance circuit further comprises a voltage detector detecting a voltage between the grounded point and a detection node remote from the grounded point.

10. The backlight assembly of claim 7, wherein the cold cathode fluorescent lamps are each disposed horizontally and arranged vertically with respect to one another.

11. The backlight assembly of claim 10, wherein each of the primary coils is directly connected between at least one pair of the cold cathode fluorescent lamps located at vertically symmetrical positions.

12. The backlight assembly of claim 10, wherein each of the primary coils is directly connected either between a cold cathode fluorescent lamp at a highest position and a cold cathode fluorescent lamp at a lowest position of the cold cathode fluorescent lamps or between two adjacent cold cathode fluorescent lamps among remaining cold cathode fluorescent lamps.

13. The backlight assembly of claim 10, wherein the cold cathode fluorescent lamps are disposed in a vertically-standing protection structure having a rear surface covered with a reflection plate and a front surface covered with a diffusion plate.

14. A liquid crystal display comprising:

a liquid crystal panel receiving a light to display an image; and a backlight assembly, wherein the backlight assembly comprises:

an even number of cold cathode fluorescent lamps disposed in one direction to provide the liquid crystal panel with the light;

a first electrode supplying a first voltage having a polarity to even-numbered cold cathode fluorescent lamps among the cold cathode fluorescent lamps;

a second electrode supplying a second voltage having an opposite polarity to the first voltage to odd-numbered cold cathode fluorescent lamps among the cold cathode fluorescent lamps; and a balance circuit controlling currents flowing through the cold cathode fluorescent lamps, wherein the cold cathode fluorescent lamps are halved into a first group higher in temperature and a second group lower in temperature than the first group, and the balance circuit comprises:

a plurality of primary coils directly connected to the lamps, at least one primary coil of the plurality of primary coils is directly connected between a cold cathode fluorescent lamp at a highest position of the first group and a cold cathode fluorescent lamp at a lowest position of the second group; and a plurality of secondary coils corresponding to the primary coils and connected to each other to form a loop.

15. The liquid crystal display of claim 14, wherein each of the primary coils is directly connected between at least one of the odd-numbered cold cathode fluorescent lamps in the first group and at least one of the even-numbered cold cathode fluorescent lamps in the second group, or between at least one of the even-numbered cold cathode fluorescent lamps in the first group and at least one of the odd-numbered cold cathode fluorescent lamps in the second group.

16. The liquid crystal display of claim 15, wherein one point of the secondary coils connected to each other is grounded, and the balance circuit further comprises a voltage detector detecting a voltage between the grounded point and a detection node remote from the grounded point.

17. The liquid crystal display of claim 14, wherein the cold cathode fluorescent lamps are each disposed horizontally and arranged vertically with respect to one another.

18. The liquid crystal display of claim 17, wherein each of the primary coils is directly connected between at least one pair of the cold cathode fluorescent lamps located at vertically symmetrical positions.

19. The liquid crystal display of claim 17, wherein each of the primary coils is directly connected either between a cold cathode fluorescent lamp at a highest position and a cold cathode fluorescent lamp at a lowest position of the cold cathode fluorescent lamps or between two adjacent cold cathode fluorescent lamps among remaining cold cathode fluorescent lamps.

20. The liquid crystal display of claim 17, wherein the cold cathode fluorescent lamps are disposed in a vertically-standing protection structure having a rear surface covered with a reflection plate and a front surface covered with a diffusion plate.

* * * * *